US005150675A

United States Patent [19]

Murata

[11] Patent Number: 5,150,675

[45] Date of Patent: Sep. 29, 1992

[54] CYLINDER HEAD ASSEMBLY FOR USE IN INTERNAL COMBUSTION ENGINE

[75] Inventor: Shinichi Murata, Kyoto, Japan

[73] Assignee: Mitsubishi Jidosha Kogyo Kabushiki Kaisha, Tokyo, Japan

[21] Appl. No.: 798,753

[22] Filed: Nov. 27, 1991

[30] Foreign Application Priority Data

Nov. 29, 1990 [JP] Japan ..... 2-126833[U]

[51] Int. Cl.[5] ..... F02F 3/00

[52] U.S. Cl. ..... 123/193.5; 123/90.38; 123/90.34; 123/90.16; 123/195 H

[58] Field of Search ..... 123/193.5, 90.34, 195 H, 123/90.16, 90.17, 90.38, 90.34

[56] References Cited

U.S. PATENT DOCUMENTS

| | | | |
|---|---|---|---|
| 4,291,650 | 9/1981 | Formia et al. | 123/193.5 |
| 4,537,166 | 8/1985 | Kimura et al. | 123/90.34 |
| 4,651,691 | 3/1987 | Ogawa | 123/195 H |
| 4,807,574 | 2/1989 | Shibata et al. | 123/90.34 |
| 4,823,747 | 4/1989 | Wagner et al. | 123/193.5 |

*Primary Examiner*—E. Rollins Cross
*Assistant Examiner*—M. Macy

[57] ABSTRACT

A cylinder head assembly for ues in an internal combustion engine is provided, which includes a valve drive mechanism having a plurality of pairs of a rocker-arm shaft and a rocker arm, the rocker shafts being rotatably supported by a rocker shaft cap incooperation with journals of a cylinder head, and the rocker arms being swingable together with the rocker-arm shafts. The rocker shaft cap has a plurality of cap portions for supporting the rocker-arm shafts, disposed in parallel with each other in one direction, and corresponding in number to journal portions of the cylinder head, and pairs of beam portions respectively supporting both sides of the plurality of cap portions, and extending in parallel with each other in the one direction, wherein the cap portions and pairs of beam portions are formed to be integral with each other thereby to constitute a ladder frame structure. Oil paths are formed in the cap portions and beam portions.

4 Claims, 6 Drawing Sheets

CYLINDER HEAD ASSEMBLY FOR USE IN INTERNAL COMBUSTION ENGINE

BACKGROUND OF THE INVENTION

1. Field of the Invention

The present invention relates to a cylinder head assembly for use in a internal combustion engine, and particularly, to the structure of a rocker-arm shaft cap of the cylinder head assembly.

2. Description of the Related Art

As a valve drive mechanism, a variable valve timing mechanism is well-known in which two kinds of cams, i.e., a cam for high rotational speed and a cam for low rotational speed, having different profiles are coupled with a camshaft, and these two cams are hydraulically switched from one to the other such that valves are driven by the low rotational speed type cam when the engine is driven within a low rotational speed range or by the high rotational speed type cam when the engine is driven within a high rotational speed range. Such switching is done for the purpose of improving the output torque of the engine within a high rotational speed range, and at the same time, maintaining drivability thereof within the low rotational speed range, i.e., ensuring high torque within the low rotational speed range. Various structures have been proposed as the structure of such a variable valve timing mechanism, and there has been proposed a structure for a variable valve timing mechanism as shown in FIGS. 12 and 13, which is disclosed in U.S. patent application Ser. No. 725,605 filed Jul. 3, 1991.

The variable valve timing mechanism 1 shown in FIGS. 12 and 13 includes two valves 2 and 3, T-shaped rocker arm 5 for opening and closing valves 2 and 3, low rotational speed type rocker arm 6, a high rotational speed type rocker arm 7, pistons 8 and 9 included in T-shaped rocker arm 5, for selectively coupling low rotational speed type rocker arm 6 or high rotational speed type rocker arm 7 with T-shaped rocker arm 5, and low and high rotational speed type cams 14 and 15 formed on cam shaft 13.

T-shaped rocker arm 5 has base end 5*a*, and rocker-arm shafts 4 and 4' are integrally formed so as to project from both sides of base end 5*a*. Rocker-arm shafts 4 and 4' are rotatably supported by rocker shaft journals 12 and 12'. Oil pressure P is applied to piston 8 through oil path 4*a* provided in journal 12' and shaft 4', and oil pressure P is also applied to piston 9 through oil path 4*a* provided in journal 12 and shaft 4.

Low rotational speed type rocker arm 6 and high rotational speed type rocker arm 7 respectively have shaft holes 6*a* and 7*a* at their base ends, and rocker-arm shafts 4' and 4 of rocker arm 5 are respectively engaged in the shaft holes 6*a* and 7*a*, thereby to support low and high rotational speed type rocker arms 6 and 7 such that they can swing. Roller bearings 10 and 11 are provided at the distal ends of low and high rotational speed type rocker arms 6 and 7, respectively. These roller bearings 10 and 11 can rotate when brought into contact with respective low and high rotational speed type cams 14 and 15.

When the engine is driven within a low rotational speed range, piston 8 is forced out of a piston hole by the spring force of spring 17', and the top of piston 8 is inserted into piston hole 6*b* of low rotational speed type rocker arm 6, as is shown in FIG. 13. In this case, low rotational speed type rocker arm 6 and T-shaped rocker arm 5 are coupled with each other, thereby to serve as one single unit, so that low rotational speed type cam 14 drives valves 2 and 3 through low rotational speed type rocker arm 6 and T-shaped rocker arm 5.

On the other hand, piston 9 is maintained in a piston hole by the spring force of spring 17, so that high rotational speed type rocker arm 7 can freely swing, when released from being coupled with T-shaped rocker arm 5, as is shown in FIG. 13.

When the engine runs in a high rotational speed range, oil pressure P is supplied to oil path 4*a* (see FIG. 13) of rocker-arm shaft 4, thereby to force piston 9 out of its piston hole against the spring force of spring 17, so that the top of piston 9 returns back and is inserted into piston hole 7*b* of high rotational speed type rocker arm 7. In this case, high rotational speed type rocker arm 7 and T-shaped rocker arm 5 are coupled with each other, thereby to serve as a single unit, so that high rotational speed type cam 15 drives valves 2 and 3 through high rotational speed type rocker arm 7 and T-shaped rocker arm 5.

In an engine using a valve drive mechanism in which rocker-arm shafts 4 and 4' swing together with T-shaped rocker arm 5, as has been explained above, it is necessary to adopt a structure which functions as bearings at the portion of the cylinder head where the rocker-arm shafts 4 and 4' are supported, i.e., it is necessary to adopt a method for supporting the rocker-arm shafts, in which the rocker-arm shafts may be allowed to swing. In a conventional method, block type rocker shaft holder 20 as shown in FIG. 14, cap type rocker shaft holder 21 as shown in FIG. 15, or the like may be used to support the rocker-arm shafts.

However, in use of conventional rocker shaft holders 20 or 21, rocker-arm shafts 4 and 4' are first respectively engaged with journal portions 20*a* or 21*a* of two holders, and the holders are then incorporated into cylinder heads, one after another. Therefore, a conventional cylinder head assembly results in problems in that much time and labor are required for the installation of rocker-arm shafts, and the bearing portions of the cylinder head assembly exhibit only low rigidity.

SUMMARY OF THE INVENTION

An object of the present invention is to provide a cylinder head assembly for use in an engine in which rocker-arm shafts are integrally formed and swing together with a rocker arm, and installation of the rocker shafts is facilitated.

Another object of the present invention is to provide a cylinder head assembly which is improved in rigidity and ensures exact and proper operation of a valve drive mechanism for a long operation period.

Further, another object of the present invention is to provide a cylinder head assembly which has a simple shape, comprises a small number of components, and allows the cylinder head to have a compact size, so that the manufacturing costs can be reduced, even when oil paths for supplying lubricant oil to journal portions for supporting rocker-arm shafts or for supplying pressurized oil for controlling a variable valve timing mechanism, if provided, are incorporated in the cylinder head assembly.

According to the present invention, a cylinder head assembly for use in an internal combustion engine is provided, which includes a valve drive mechanism having a plurality of pairs of a rocker-arm shaft and a rocker arm, the rocker shafts being rotatably supported by journal portions of a cylinder head, and the rocker arms being swingable together with the rocker-arm shafts.

The cylinder head assembly according to the present invention comprises rocker shaft supporting means for supporting rocker-arm shafts incorporated in the cylinder head. The rocker shaft supporting means has a plurality of cap portions supporting the rocker-arm shafts, disposed in parallel with each other in one direction, and corresponding in number to journal portions of the cylinder head, and pairs of beam portions respectively supporting both sides of the plurality of cap portions, and extending in parallel with each other in another direction. The cap portions and pairs of beam portions are formed to be integral with each other in a ladder frame structure. Upon requirements, oil path means for supplying oil are provided in the cap portions and beam portions.

The cylinder head assembly according to the present invention is suitable for a valve drive mechanism having a function of a variable valve timing, and the valve drive mechanism comprises cam means for generating a swing force for swinging the rocker arms in synchronization with the operation of the internal combustion engine, and swing-force transmittal means provided between the cam means and the rocker arms, for transmitting or shutting off the swing force from the cam means to the rocker arms in response to pressurized oil supplied through oil path means.

The cylinder head preferably comprises a lower cylinder head and an upper cylinder head mounted thereon for supporting rocker-arm shafts in cooperation with the rocker shaft supporting means, the upper cylinder head having side wall members extending in the longitudinal direction of the cylinder head, and cross members provided transverse to the side wall members for integrally connecting the side wall members, and the journal portions are formed on the cross members.

The other objects, features, and advantages of the present invention will be more specifically explained in the following detailed description of the present invention.

DETAILED DESCRIPTION OF THE PREFERRED EMBODIMENTS

Figure 12:
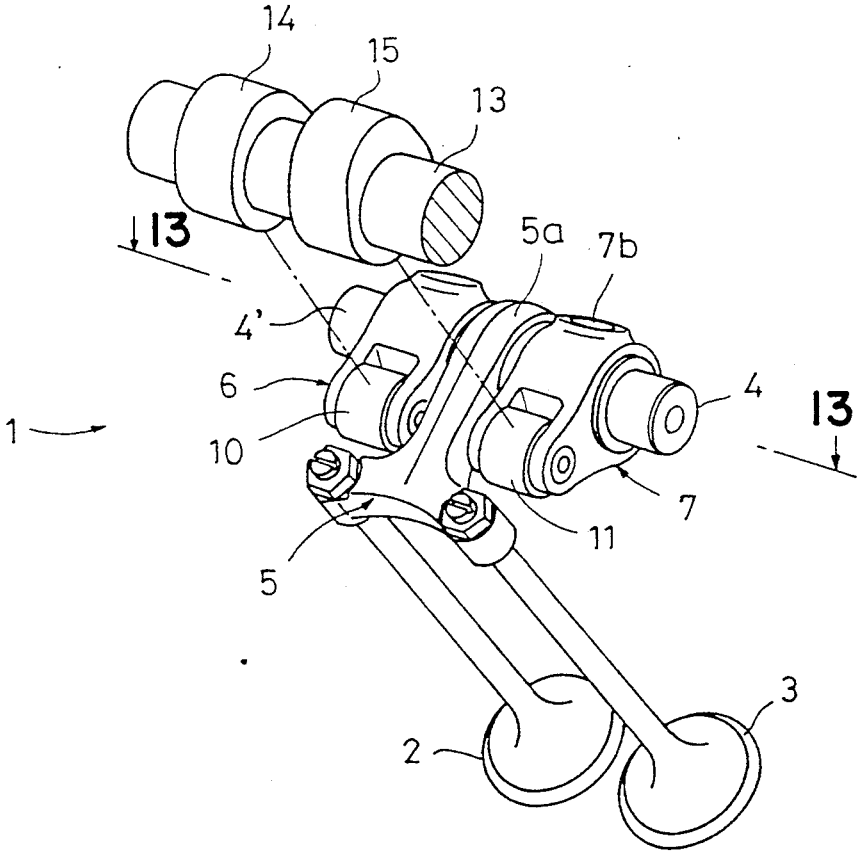
FIG. 12 is an perspective view showing the construction of an example of a variable valve timing mechanism.
Figure 13:
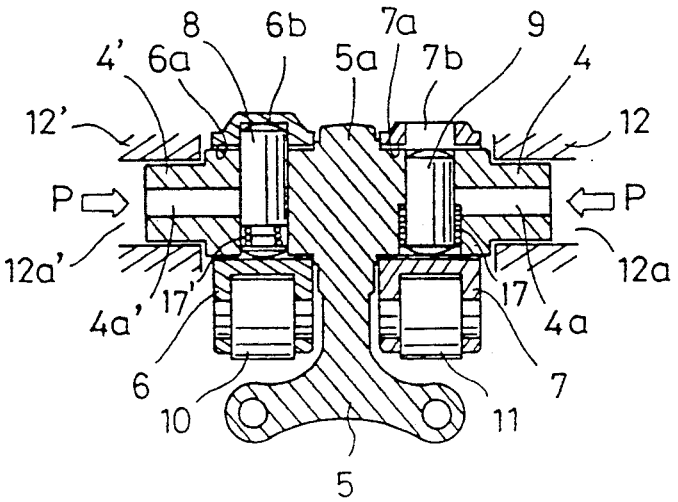
FIG. 13 is a cross-sectional view taken along line 13—13 shown in FIG. 12.
Figure 14:
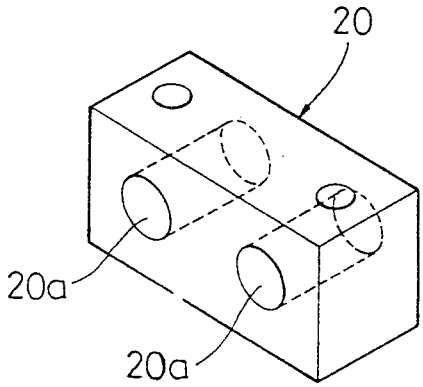
FIG. 14 (PRIOR ART)
FIG. 14 is a perspective view of a conventional rocker shaft supporting member.
Figure 15:
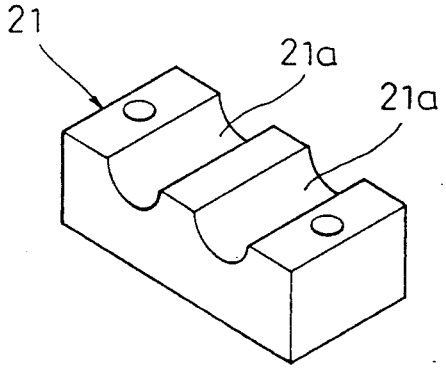
FIG. 15 (PRIOR ART)
FIG. 15 is a perspective view of an another conventional rocker shaft supporting member.

The cylinder head assembly according to the embodiment of the present invention is applicable to any valve drive mechanism, as far as the mechanism uses rocker-arm shafts and a rocker arm which swing as an integral unit, and is especially suitable for use in a variable valve timing mechanism as shown in FIGS. 12 and 13.

Figure 1:
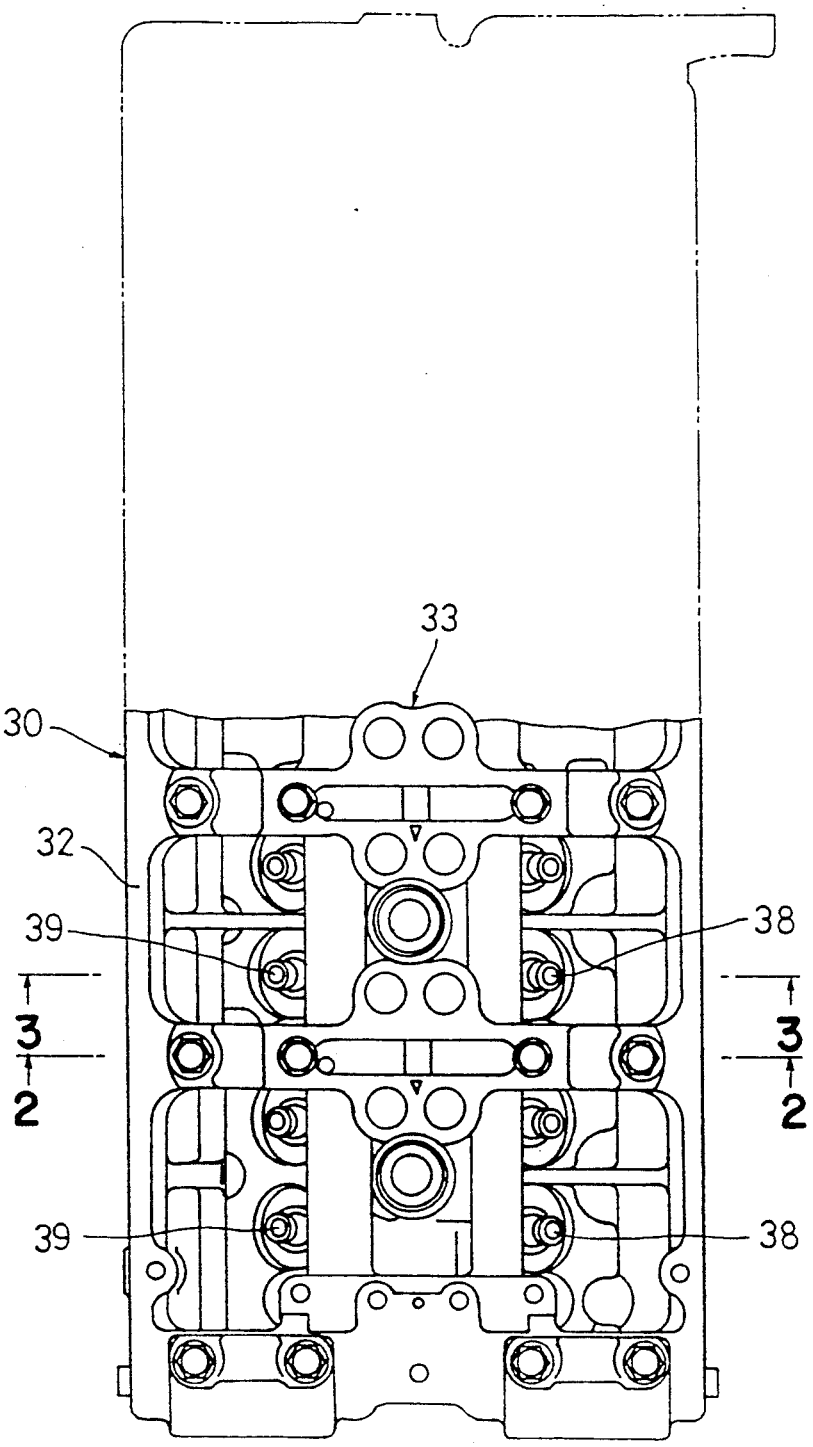
FIG. 1 is a partial schematic plan view of a cylinder head assembly according to an embodiment of the present invention.
Figure 2:
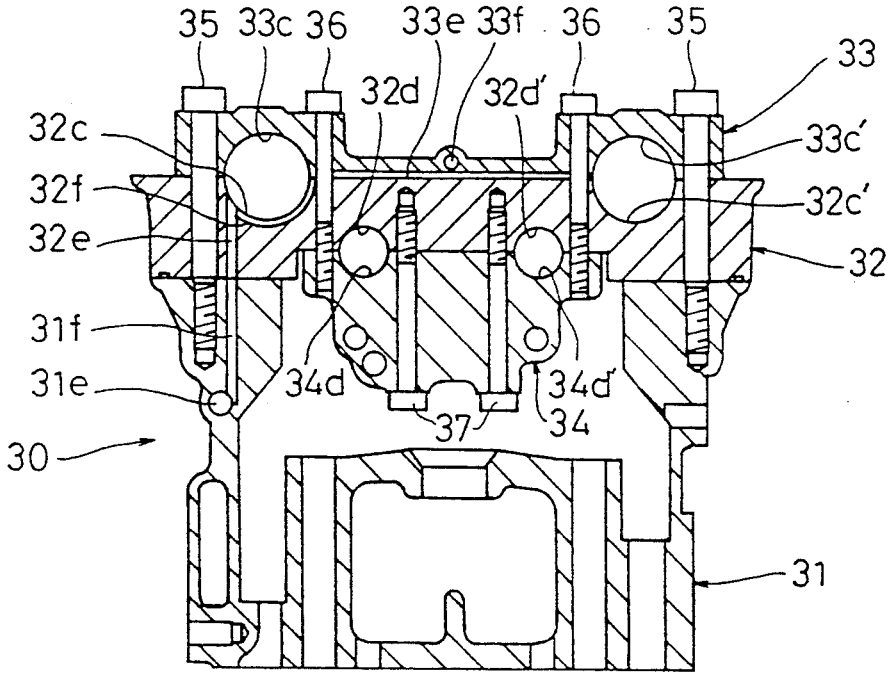
FIG. 2 is a cross-sectional view taken along line 2—2 shown in FIG. 1.
Figure 3:
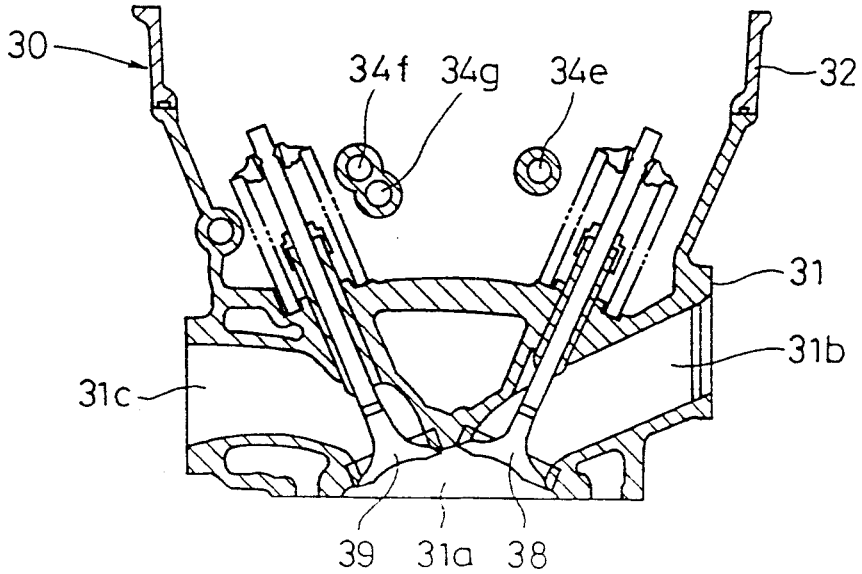
FIG. 3 is a cross-sectional view taken along line 3—3 shown in FIG. 1.

In FIGS. 1 to 3, cylinder head assembly 30 is a split type cylinder head which is divided into upper and lower blocks, and includes lower cylinder head 31 (referred to simply as a "cylinder head" hereinafter), upper cylinder head 32 (referred to simply as "camshaft holder" hereinafter), cam cap 33, and rocker shaft cap 34. Camshaft holder 32 is mounted on cylinder head 31, and cam cap 33 is mounted on camshaft holder 32. Camshaft holder 32 and cam cap 33 are fixed to cylinder head 31 by bolts 35 and 36. Rocker shaft cap 34 is fixed to the lower surface of camshaft holder 32 by bolts 37.

As is shown in FIG. 3, combustion chambers 31*a*, inlet ports 31*b*, and outlet ports 31*c* are formed in cylinder head 31, and combustion chambers 31*a* are each provided with inlet valves 38, outlet valves 39, and an ignition plug (not shown).

Figure 4:
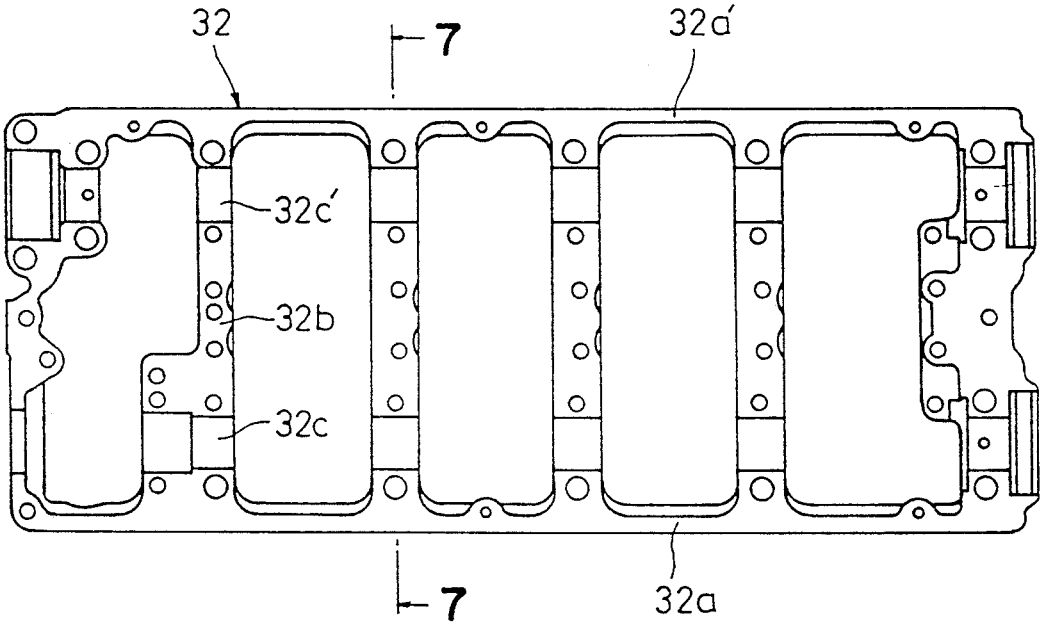
FIG. 4 is a plan view of a camshaft holder shown in FIG. 1.
Figure 5:
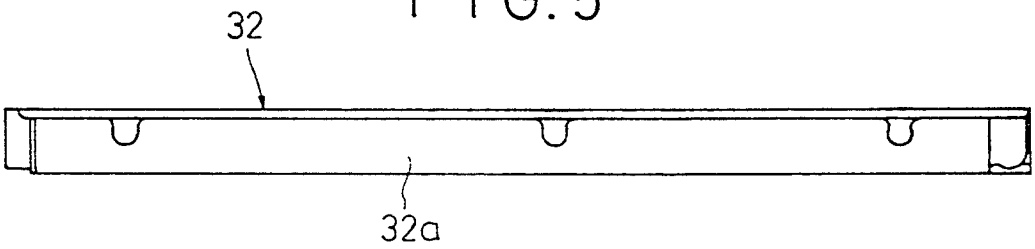
FIG. 5 is a side view of the camshaft holder shown in FIG. 4.
Figure 6:
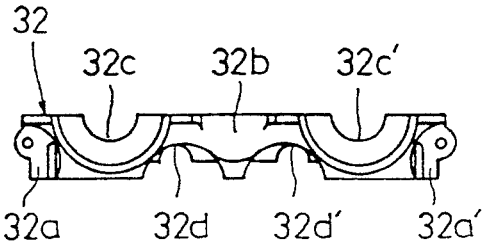
FIG. 6 is a end view of the camshaft holder shown in FIG. 4.
Figure 7:
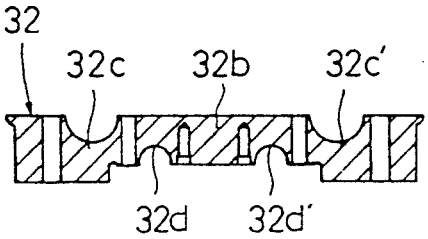
FIG. 7 is a cross-sectional view taken along line 7—7 shown in FIG. 4.

Camshaft holder 32 constitutes a ladder frame structure as is shown in FIG. 4, in which cross members 32*b* are formed so as to integrally connect both side walls 32*a* and 32*a'* extending in the longitudinal direction, and are positioned so as to respectively correspond to journals of camshafts. Cam journal portion 32*c* for receiving a cam shaft coupled with the inlet valve, and another cam journal portion 32*c'* for receiving another cam shaft coupled with the outlet valve are formed in both end portions of the upper surface of each cross member 32*b* (see FIGS. 6 and 7). These cam journal portions 32*c* and 32*c'* have a semicircular cross section.

Journal portion 32*d* for receiving a rocker-arm shaft coupled with the inlet valve, and another journal portion 32*d'* for receiving another rocker-arm shaft coupled with the outlet valve are formed in the lower surface of camshaft holder 32. These journal portions 32*d* and 32*d'* have a semicircular cross section. In this manner, camshaft holder 32 constitutes an integral structure by connecting cam journal portions 32*c* and 32*c'* opposite to each other, respectively coupled with the inlet and outlet valves. As a result of this, camshaft holder 32 is greatly improved in rigidity.

Cam journal portions 33*c* and 33*c'* are formed in the lower surface of cam cap 33 (see FIG. 2), such that they are positioned so as to respectively correspond to the positions of cam journal portions 32*c* and 32*c'* of cross member 32*b*. These cam journal portions 33*c* and 33*c'* have a semicircular cross section. Cam journal portions 32*c* and 33*c*, as well as cam journal portions 32*c'* and 33*c'*, are coupled with each other thereby to form a complete cam journal portion which has a circular cross section.

Figure 8:
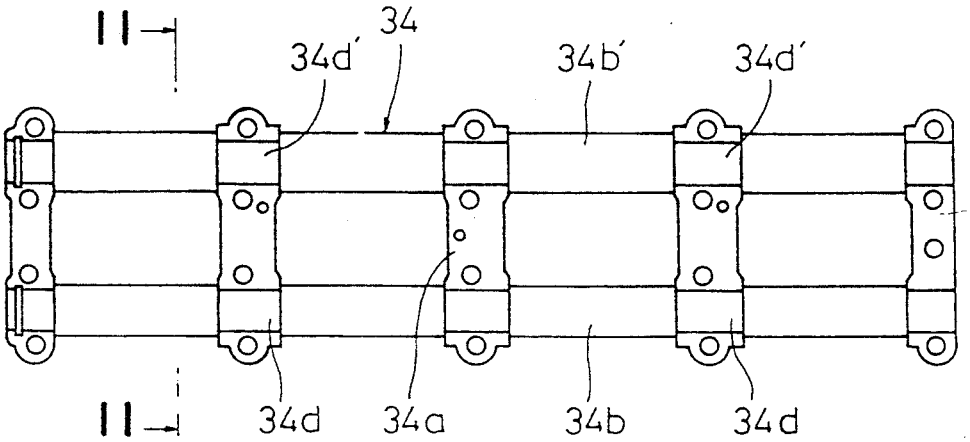
FIG. 8 is a plan view of the rocker shaft cap shown in FIG. 2.
Figure 9:
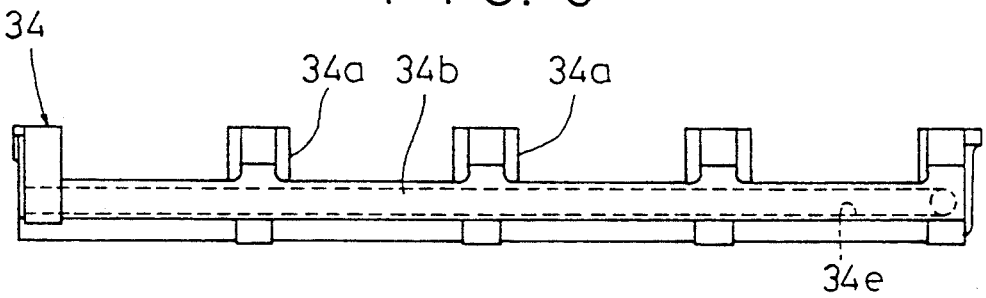
FIG. 9 is a side view of the rocker shaft cap shown in FIG. 8.
Figure 10:
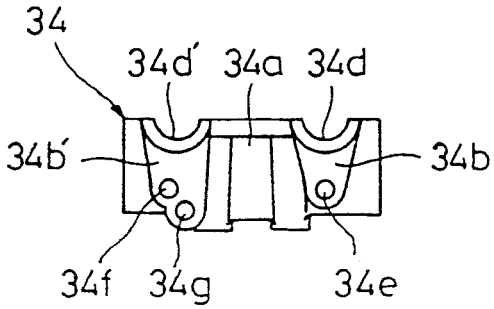
FIG. 10 is a end view of the rocker shaft cap shown in FIG. 9.
Figure 11:
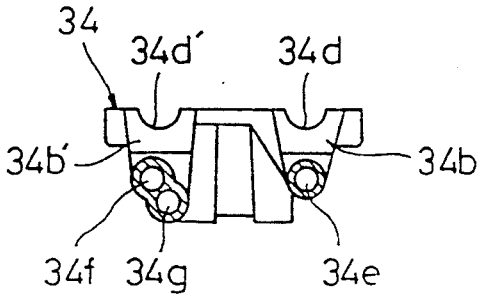
FIG. 11 is a cross-sectional view taken along line 11—11 shown in FIG. 8.

As is shown in FIG. 8, rocker shaft cap 34 has a ladder frame structure, in which a plurality of cap portions 34*a* respectively corresponding to cross members 32*b* of camshaft holder 32 are formed such that each cap portion is integral with a pair of beam portions 34*b* and 34*b'* respectively connected to both ends of the cap portion 34*a*. Journal portions 34*d* and 34*d'* for respectively supporting the rocker-arm shafts at the positions corresponding to journal portions 32*d* and 32*d'* are formed in the upper surface of each cap portion 34*a*. These journal portions 34*d* and 34*d'* have a semicircular cross section. Journal portions 32*d* and 34*d*, as well as journal portions 32*d'* and 34*d'*, are coupled with each other thereby to form a complete rocker shaft journal portion having a circular cross section.

Oil path 34*e* is provided in beam portion 34*b* connected to an end of rocker shaft cap 34, and oil paths 34*f* and 34*g* are provided in beam portion 34*b'* connected to the other end thereof. These oil paths are communicated to an oil pump not shown, and serve to supply a variable timing mechanism with oil used for timing control. For example, within a lower rotational speed range, a variable timing mechanism shown in FIG. 12 shuts off the oil supply to piston 9, thereby releasing rocker-arm shaft 4 from the coupling with piston 9, and separating high rotational speed type rocker arm 7 from T-shaped rocker arm 5. On the other hand, within a higher rotational speed range, the variable timing mechanism supplies oil to piston 8 thereby releasing rocker-arm shaft 4' from the coupling with piston 8, and separating low rotational speed type rocker arm 6 from T-shaped rocker arm 5. Moreover, the variable valve timing mechanism can supply and shut off the oil thereby to separate both high and low rotational speed rocker arms 6 and 7, coupled with the inlet and outlet valves of a specified cylinder, from the T-shaped rocker arm 5. When both of high and low rotational speed type rocker arms 6 and 7 of a specified cylinder are separated from the T-shaped rocker arm 5, both the inlet and outlet valves of the cylinder do not operate, so that intake gas is not supplied to the cylinder any more and exhaust gas remaining in the combustion chamber is sealed in the chamber. In this condition, the specified cylinder stops operating.

Oil paths 34*f* and 34*g* provided in beam portion 34*b'* are necessary, for example, when the operation of the inlet and outlet valves coupled with the first, third, and fifth cylinders of a six cylinder engine are stopped, and only the inlet and outlet valves of the other cylinders are driven, while the engine is driven at a low rotational speed. More specifically, when the first, third, and fifth cylinders are stopped, oil is supplied to pistons 8 of the first, third, and fifth cylinders through oil paths 34*f*, thereby to release the engagements between rocker-arm shafts 4' and pistons 8 coupled with those cylinders. On the other hand, oil is not supplied to oil path 34*g* connected to pistons 8 of the other cylinders, i.e., the second, fourth, and sixth cylinders, and thus, the engagements between rocker-arm shafts 4' and pistons 8 coupled with these cylinders are maintained.

Because oil paths are thus provided in beam portions 34*b* and 34*b'* connected to each of cap portions 34*a* of rocker shaft cap 34, and are used for controlling the variable valve timing mechanism, the oil supply system of each cap portions is not complicated, and the structure of the entire cylinder head can be made compact.

As shown in FIG. 2, pairs of oil paths 31*e* and 31*f*, 32*e* and 32*f*, and 33*e* and 33*f* are respectively provided in cylinder head 31, camshaft holder 32, and cam cap 33. Oil path 31*e* of cylinder head 31 is communicated to an oil pump not shown, and the oil delivered out of the oil pump is supplied to cam journal portions 32*c* and 32*c'* through the above-mentioned oil paths.

Installation of the cam shafts and rocker-arm shafts of the valve drive mechanism will be explained hereinbelow.

In each of valve drive mechanisms, e.g., in a variable valve timing mechanism as shown in FIG. 12, camshafts are first engaged with cam journal portions 32*c* and 32*c'* of camshaft holder 32, and thereafter, cam cap 33 is mounted on camshaft holder 32 thereby to support the camshaft therebetween. Cam cap 33 and camshaft holder 32 are then fixed to cylinder head 31 by bolts 35 and 36.

Rocker-arm shafts of each variable valve timing mechanism are first engaged with journal portions 32*d* and 32*d'* of camshaft holder 32, with bearings, not shown, inserted therebetween, and thereafter, rocker shaft cap 34 is mounted on the camshaft holder thereby to support the rocker-arm shafts between the rocker shaft cap and the camshaft holder. More specifically, after camshaft holder 32 is turned upside down, the rocker-arm shafts are engaged with journal portions 32*d* and 32*d'* turned upward, and rocker shaft cap 34 is then mounted on the camshaft holder 32, such that the rocker-arm shafts are rotatably supported by journal portions 34*d* and 34*d'* of each cam portion 34*a*. Finally, rocker shaft cap 34 is fixed to camshaft holder 32 by bolt 37. Each of the rocker-arm shafts can thus be at once incorporated in cylinder head 31.

Thus, since camshaft holder 32 constitutes a ladder frame structure in which opposite cam journal portions 32*c* and 32*c'* respectively coupled with inlet and outlet valves are connected with each other, and since rocker shaft cap 34 also constitutes a ladder frame structure, both the camshaft holder and the rocker shaft cap are improved in rigidity, so that the entire head assembly 30 is improved in rigidity.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A cylinder head assembly for use in an internal combustion engine, which includes a valve drive mechanism having a plurality of pairs of a rocker-arm shaft and a rocker arm, the rocker-arm shafts being rotatably supported by journal portions of a cylinder head, and the rocker arms being swingable together with the rocker-arm shafts, said cylinder head assembly comprising:

rocker shaft supporting means for supporting the rocker-arm shafts incorporated in the cylinder head, said rocker shaft supporting means having a plurality of cap portions supporting the rocker-arm shafts, disposed in parallel with each other in one direction, and corresponding in number to journal portions of the cylinder head, and pairs of beam portions respectively supporting both sides of the plurality of cap portions, and extending in parallel with each other in another direction, wherein the cap portions and pairs of beam portions are formed to be integral with each other in a ladder frame structure.

2. A cylinder head assembly according to claim 1, further comprising oil path means formed in the cap portions and beam portions for allowing oil to flow.

3. A cylinder head assembly according to claim 2, wherein the valve drive mechanism further comprise cam means for generating a swing force for swinging the rocker arms in synchronization with the operation of the internal combustion engine, and swing force transmittal means provided between the cam means and the rocker arms, for transmitting or shutting off the swing force from the cam means to the rocker arms in response to pressurized oil supplied through the oil path means.

4. A cylinder head assembly according to claim 1, wherein the cylinder head comprises a lower cylinder head and an upper cylinder head mounted thereon for supporting the rocker-arm shafts in cooperation with the rocker shaft supporting means, the upper cylinder head having side wall members extending in the longitudinal direction of the cylinder head, and cross members provided transverse to the side wall members for integrally connecting the side wall members, and the journal portions are formed on the cross members.

* * * * *